US008777222B2

(12) United States Patent
Dunn et al.

(10) Patent No.: US 8,777,222 B2
(45) Date of Patent: Jul. 15, 2014

(54) DOCUMENT STACKING

(75) Inventors: Frank B. Dunn, Waterloo (CA); Anthony Boon, Kitchener (CA); Fred Kallin, Waterloo (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/308,157

(22) Filed: Nov. 30, 2011

(65) Prior Publication Data

US 2013/0134669 A1 May 30, 2013

(51) Int. Cl.
*B65H 29/20* (2006.01)

(52) U.S. Cl.
USPC ..... 271/314; 271/220

(58) Field of Classification Search
USPC ..... 271/207, 209, 213, 220, 214, 217, 4.08, 271/3.14, 188, 314
See application file for complete search history.

(56) References Cited

U.S. PATENT DOCUMENTS

| | | | | |
|---|---|---|---|---|
| 7,055,818 | B2 * | 6/2006 | Furusawa | 271/220 |
| 7,793,931 | B2 * | 9/2010 | Mizuno | 271/207 |
| 2004/0070141 | A1 * | 4/2004 | Michels et al. | 271/220 |
| 2006/0078363 | A1 * | 4/2006 | Terao et al. | 399/407 |

* cited by examiner

*Primary Examiner* — Michael McCullough
(74) *Attorney, Agent, or Firm* — Joseph P. Mehrle

(57) ABSTRACT

An apparatus and method are disclosed for stacking items of media in a media container region. The apparatus includes a rotatable roller element arranged to rotate about a longitudinal axis to locate an incoming item of media at a deposit position with the container region. The apparatus also includes at least one trailing edge engaging element that engages with a trailing edge region of an incoming item of media and urges the trailing edge region towards a stack position. The apparatus also includes at least one preceding item edge engaging element that engages with an edge region of a preceding item of media to urge that edge region away from the incoming item of media.

26 Claims, 4 Drawing Sheets

DOCUMENT STACKING

FIELD OF THE INVENTION

The present invention relates to an apparatus and method for stacking items of media in a container. In particular, but not exclusively, the present invention relates to the storage of currency notes and/or checks in a stacking or reject bin of an automated teller machine (ATM).

BACKGROUND TO THE INVENTION

Media depositories are used to receive media items from a customer. One common type of media depository is a sheet media depository for receiving items of media in sheet form. For example, such items of media can be currency notes, checks, tickets, giros or the like.

Sheet media depositories are used in automated teller machines (ATMs) and other self-service terminals. Other such self-service terminals are vending machines, change machines, teller units, cash recyclers or the like. The sheet media depositories are used to identify, validate and store or return deposited sheets.

Some sheet depositories are capable of receiving a bunch of sheets in a loading area and then picking individual sheets from the bunch so that each sheet can then be identified and validated individually prior to storage of the validated sheet within a depository or returned to a customer. These depositories are sometimes referred to as bunch sheet depositories. Bunch sheet depositories may transport the bunch from a loading area to a picking area or the picking area may be adjacent to the loading area.

Bunches of items of media such as currency notes and/or checks are thus deposited by a user and, subsequent to a user agreement step and item verification step, these items are stored semi-permanently within a self-service terminal until security staff or bank staff come to empty the storage unit. The storage unit is sometimes referred to as a stacking bin. Alternatively, when an input item is identified as being an illicit or damaged item, the item is stored in a storage unit referred to as a reject bin.

In prior known stacking bins, items such as checks or currency notes are driven through a paper transport system using pairs of rollers that pinch the items and rotate to drive the items along a pre-determined pathway. At a final pair of rollers, the items are pushed into a stack of items being stored. Often, the lead edge of an item being fed into an extant stack can collide with the trailing edge of items already in the stack. This causes the items in the stack to buckle and fold up, making them difficult to retrieve afterwards. Buckled and folded items also take up more space than neatly stacked items and thus reduce overall storage capacity.

Where the stacking bins are so-called horizontal stacking bins, the issue of colliding items is an issue. However, the issue of colliding items in the bin is even more prevalent and serious in a stacking bin type called a vertical bin in which introduced items of media are inclined to drop to the bottom of the bin with the assistance of gravity. In either type, the order in which incoming items of media are received may be lost when buckled and/or folded items collide. When the order is lost, additional time is usually required later at a back office facility of a financial institution to sort through the deposited and stored items to a pre-determined order in which the items were received. Jams may also occur which can lead to service down time and may be costly to clear.

SUMMARY OF THE INVENTION

It is an aim of the present invention to at least partly mitigate the above-mentioned problems.

It is an aim of certain embodiments of the present invention to provide an apparatus and a method for stacking items of media in a stacking bin whereby incoming items of media are duly located in a desired position and preceding items of media are kept out of the way so as to not collide with the incoming item of media.

It is an aim of certain embodiments of the present invention to provide a vertical storage bin in which an incoming item of media is prevented from dropping away from rollers driving the item.

It is an aim of certain embodiments of the present invention to provide a method and apparatus which can simultaneously pinch incoming items of media so as to duly support the items at a desired location, whilst locating them at a desired position in a stack and whilst keeping preceding items of media already located in the stacking bin out of the way of an incoming item.

According to a first aspect of the present invention, there is provided apparatus for stacking items of media in a media container region, comprising:

- a rotatable roller element arranged to rotate about a longitudinal axis to locate an incoming item of media at a deposit position within a container region;
- at least one trailing edge engaging element that engages with a trailing edge region of the incoming item of media and urges the trailing edge region towards a stack position; and
- at least one preceding item edge engaging element that engages with an edge region of a preceding item of media to urge said an edge region away from the incoming item of media.

Aptly, said at least one trailing edge engaging element comprises a plurality of flexible paddle elements and said at least one preceding item edge engaging element comprises a plurality of flexible flap elements, said paddle elements and said flap elements being supported in a circumferentially spaced apart relationship on said roller element and arranged to rotate simultaneously therewith.

Aptly, the flap elements extend further from a common axis of rotation than the paddle elements.

Aptly, the roller element is a driven roller opposed with a respective pinch idler element.

Aptly, the apparatus further includes a support surface and an opposed pinch plate, the plate element being resiliently biased against the support surface to provide a pinch point to locate a pinch region of an incoming item of media; wherein the support surface and pinch plate element are located whereby an item of media held at the pinch point has a trailing edge region located for engagement with said trailing edge engaging element.

Aptly, the support surface has a curved cross-section to cup an incoming item of media as it is pinched between the support surface and the plate element.

Aptly, the pinch plate element is a substantially planar plate member having a dished region at a first end region thereof where the plate element is pivotably mounted and a further end region comprising a free end biased against the support surface.

According to a second aspect of the present invention, there is provided an automated teller machine (ATM) comprising a deposit module comprising apparatus for stacking items of media in a media container region, comprising:

- a rotatable roller element arranged to rotate about a longitudinal axis to locate an incoming item of media at a deposit position within a container region;

at least one trailing edge engaging element that engages with a trailing edge region of the incoming item of media and urges the trailing edge region towards a stack position; and at least one preceding item edge engaging element that engages with an edge region of a preceding item of media to urge said an edge region away from the incoming item of media.

According to a third aspect of the present invention, there is provided a method of stacking items of media in a media container, comprising the steps of:

rotating a roller element about a longitudinal axis to locate an incoming item of media at a deposit position in a media container region;

urging an edge region of a preceding item of media away from the incoming item of media via at least one preceding item edge engaging element; and urging a trailing edge of the incoming item of media towards a stack position via at least one trailing edge engagement element.

Aptly, the method further comprises the steps of, as the roller element rotates, simultaneously rotating a plurality of flexible paddle members and flexible flap elements arranged in a circumferentially spaced apart relationship on the roller element, rotation of a one of said flexible flap elements, urging said an edge region and rotation of a one of said flexible paddle elements, urging said a trailing edge.

Aptly, the method further includes the steps of locating items of media one-by-one at a presentation location proximate to said roller element, and subsequently locating each item from said presentation location to said deposit position by rotating the roller element.

Aptly, the method further includes the steps of pinching an incoming item of media located at the deposit position by urging a plate element against a support surface, a pinch region of the incoming item of media at the deposit position being located between the plate element and the support surface.

Aptly, the method further includes the step of supporting the item of media in a cupped upright position by pinching the item of media.

Aptly, the method further includes the steps of constantly rotating said roller element about a longitudinal axis to locate an incoming item of media at a deposit position in a media container region, urging an edge region of a preceding item of media away from the incoming item of media via at least one preceding item edge engaging element, and urging the trailing edge of the incoming item of media towards a stack position via at least one trailing edge engagement element.

According to a fourth aspect of the present invention, there is provided a product which comprises a computer program comprising program instructions for:

rotating a roller element about a longitudinal axis to locate an incoming item of media at a deposit position in a media container region;

urging an edge region of a preceding item of media away from the incoming item of media via at least one preceding item edge engaging element; and urging the trailing edge of the incoming item of media towards a stack position via at least one trailing edge engagement element.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
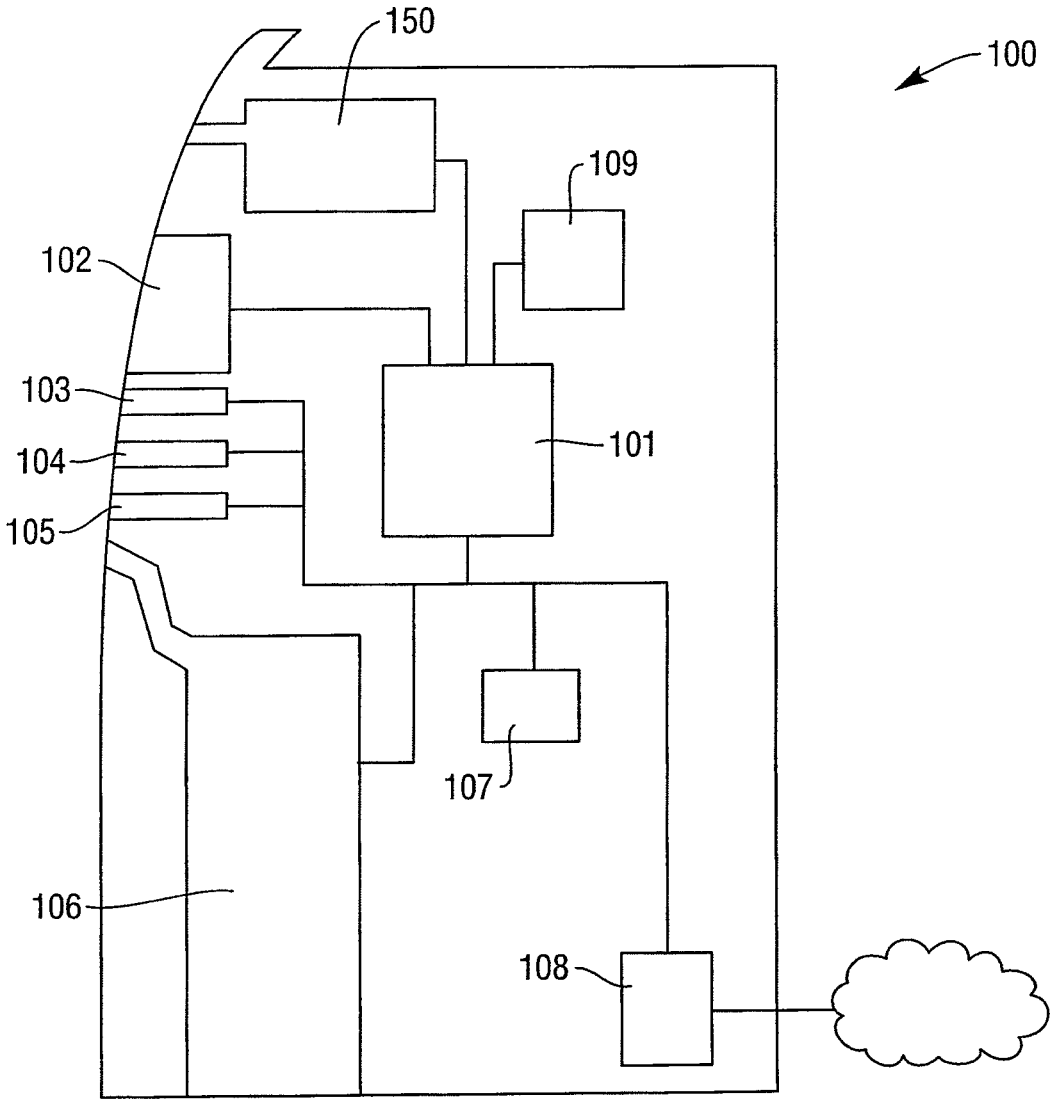
FIG. 1 is a schematic diagram of an ATM according to an embodiment of the present invention.

In the drawings like reference numerals refer to like parts.

FIG. 1 illustrates a block diagram of a self-service terminal 100 in the form of an automated teller machine (ATM) according to one embodiment of the present invention. It will be understood that certain embodiments of the present invention are applicable to other types of terminal such as ATMs, cash recyclers, teller units, vending machines, change machines and the like.

The ATM 100 includes different modules for enabling transactions to be executed and recorded by the ATM 100. These ATM modules include customer transaction modules and service personnel modules. The ATM modules include an ATM controller 101, a customer display 102, a card reader/writer module 103, an encrypting keypad module 104, a receipt printer module 105, a cash dispenser module 106, a journal printer module 107 for creating a record of every transaction executed by the ATM, a connection module 108, an operator panel module 109 for use by a service operator (such as a field engineer, a replenisher (of currency, of printed paper or the like), or the like).

Certain customer transaction modules (such as the ATM controller 101) are also used by the service personnel for implementing management functions. However, some of the modules are referred to herein as service personnel modules (such as the journal printer module 107 and the operator panel module 109) because they are never used by ATM customers.

FIG. 1 also illustrates a schematic diagram of a deposit module 150 according to one embodiment of the present invention. The deposit module 150 is operable to receive bunches of items of media such as currency notes, bank notes and/or checks from a customer. These can be stored securely or returned to a customer.

Figure 2:
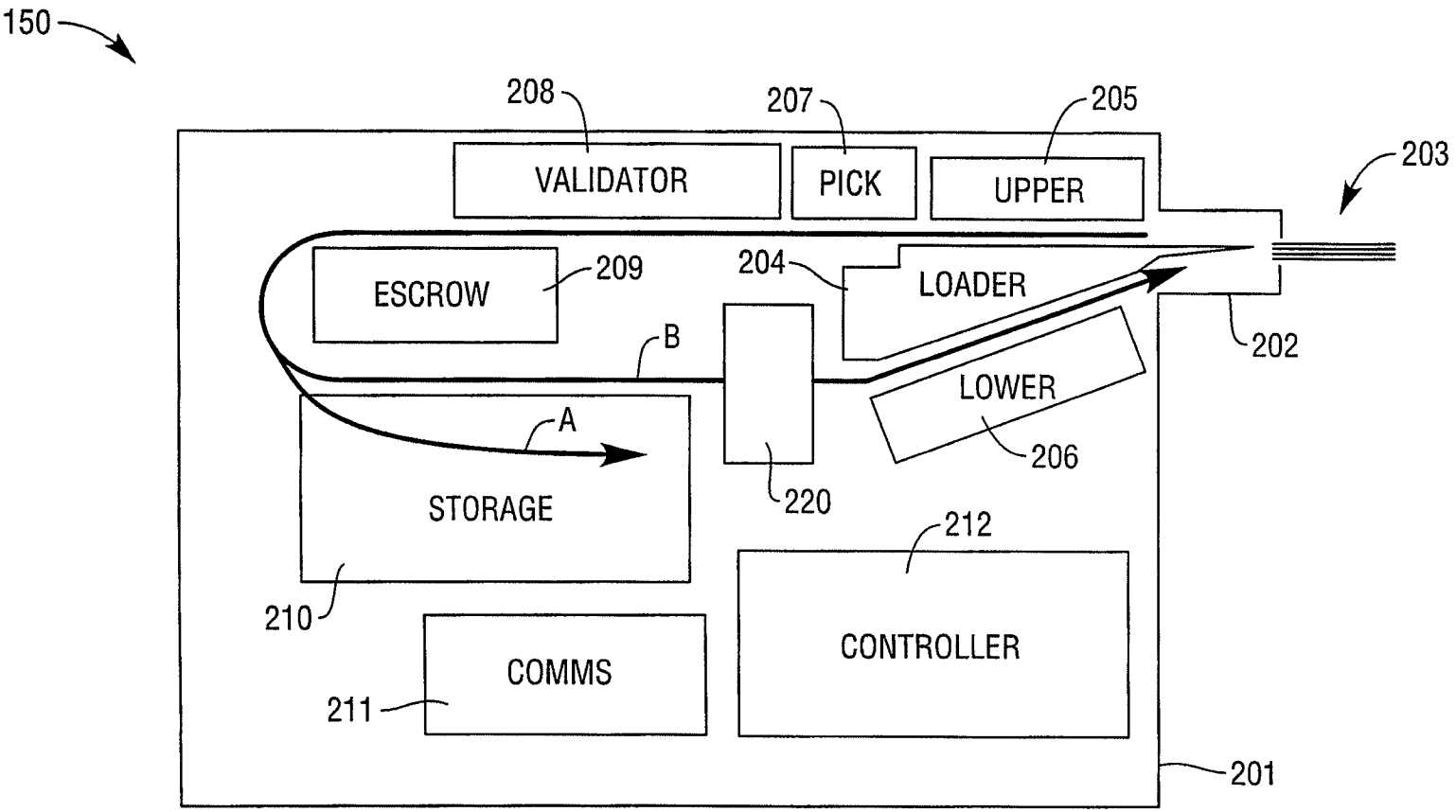
FIG. 2 is a schematic diagram of a depository according to an embodiment of the present invention.

The depository is shown in more detail in FIG. 2 and includes a chassis 201 onto which various parts are mounted. The depository 150 further includes a bunch deposit slot 202 at which a customer (not shown) can introduce a bunch 203 of currency notes or other such items of media. This enables the sheet items of media to be deposited by a customer. A bunch loader 204 co-operates with an upper loading unit 205 and a lower dispatch unit 206. These co-operate to receive the bunch of items of media and move them to a pick unit 207 or return them to a customer via slot 202 respectively. The pick unit 207 is aligned with the bunch loader 204 for removing individual sheets from the bunch of sheets 203. A sheet validator 208 determines whether the items of media are valid. An escrow 209 is provided for temporarily storing validated sheets until a customer confirms they wish to complete a transaction. A storage compartment 210 is provided as well as a communication circuit board 211 for communicating with the self-service terminal into which the depository 15 may be installed. An on-board controller 212 is provided for controlling the operation of the depository 150.

The depository 150 includes a plurality of transport units only some of which are described herein. An upper sheet transport section 205 is located above the bunch loader and adjacent to the picker 207. A lower sheet transport section 206 is located beneath the bunch loader 204 and near the bunch deposit slot 202.

The bunch loader 204 is used to transport deposited bank notes from the bunch deposit slot 202 to the pick unit 207.

There are two different routes that can be taken by an item of media that is inserted into the depository 150. A first route is shown by arrow A and involves the sheet item being picked from the bunch of sheets 203, transported to the picker unit 207, moved past the validator 208 to be identified and validated, placed in the escrow 209 and from the escrow 209 transported into the storage compartment 210.

The second optional route is shown by the arrow B and involves the sheet item being picked from the bunch of sheets 203, transported to the picker unit 207, moved past the validator 208 to be identified and validated, placed in the escrow 209 and from the escrow 209 returned to the customer via a rebunching unit 220 and via the loading unit 204 and lower transport section 206.

As will be understood by those skilled in the art, whether a sheet item is stored (that is to say, follows the route shown by arrow A) or returned to a customer (that is to say, follows a path shown by arrow B) depends on a number of factors, such as whether the sheet is recognized, whether a sheet is validated and/or whether a customer cancels or confirms a transaction or the like.

Figure 3:
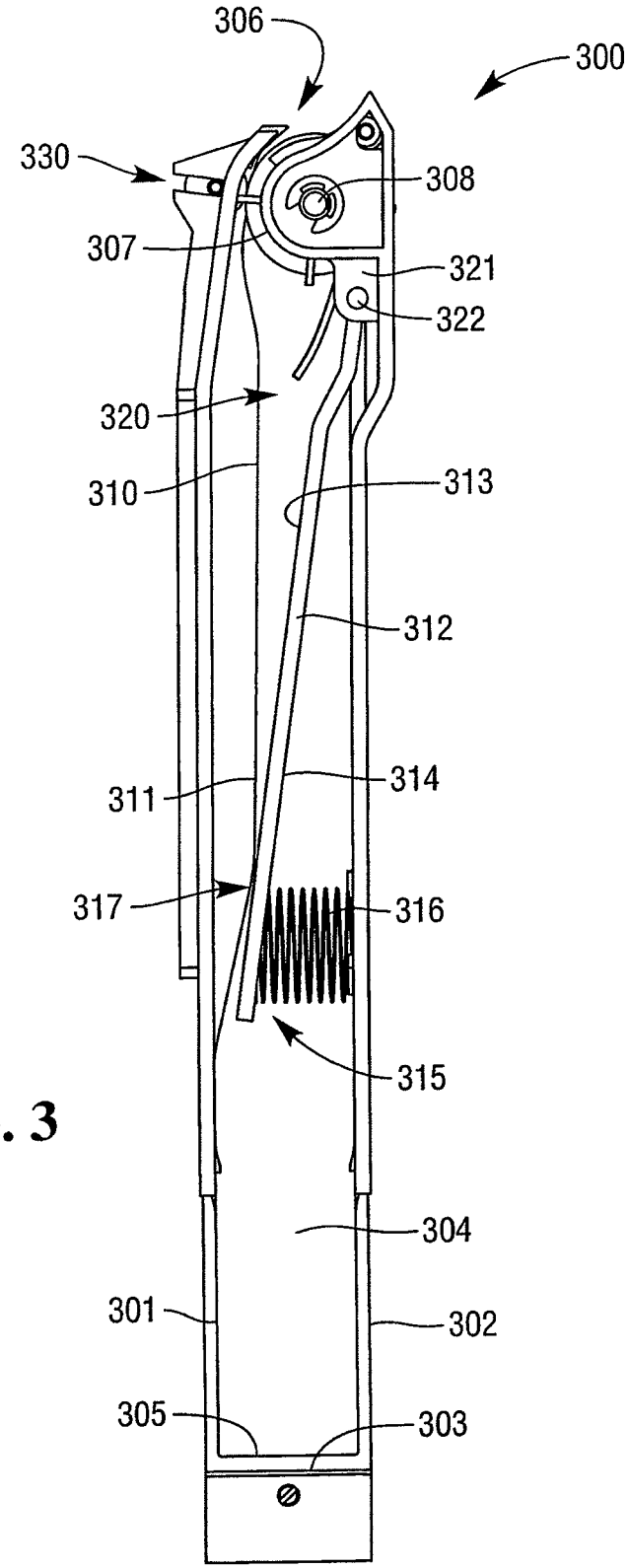
FIG. 3 illustrates a stacking mechanism in a stacking bin.

FIG. 3 illustrates a stacking mechanism 300 which is a vertical type stacking bin. It will be appreciated that certain embodiments of the present invention are applicable to horizontal type stacking bins. The stacking bin 300 includes a first side wall 301 and an opposed substantially parallel spaced apart side wall 302. These define between them a storage compartment region. The storage compartment region is closed at the bottom by an end wall 303. The walls thus provide a container with a region 304 in between the walls being a space where items of media can be stacked and thus stored.

The end wall 303 effectively provides a floor surface 305 and any items of media which drop into the container region 305 fall naturally under the influence of gravity until an edge of those items hits the end wall 303. In use items of media are introduced through a slot 306 at the top of the vertical storage bin and are driven into the inside of the bin by a rotating roller 307. The roller 307 rotates about a pivot point 308. The rotatable roller 307 is thus arranged to rotate about a longitudinal axis 308 to locate any incoming items of media one-by-one at a pre-determined position within the container region. This pre-determined position is referred to as a deposit position and an item of media located in the deposit position is shown in FIG. 3 as the sheet item 310, shown towards the upper left hand side of the container region. The incoming item of media 310 which is held at the deposit location is held at that location by a pinching force which occurs between a curved support surface 311 and an opposed pinch plate 312. The pinch plate is an essentially plate like element having an inner surface 313 and a rear surface 314. At a first end region 315 of the pinch plate, the plate is biased by a resilient spring 316 against the support surface 311. The spring 316 constantly urges the pinch plate 312 against the curved support surface 311. As a result a pinching zone 317 occurs and this pinching zone 317 pinches a region towards the leading edge of the incoming item of media. The support surface may optionally be formed integral with a side wall 301 or may be a separate piece secured to the side wall.

A further end region 320 of the pinch plate 312 has a dished cross-sectional profile before the very end of the pinch plate which is pivotably mounted into a mount 321 which extends from the side wall 302. The pinch plate 312 thus pivots about an axis of rotation 322. The pinch plate thus has a free end and a pivotably mounted end. The free end is urged against a support which extends from a side wall 301 of the vertical stacking bin and thus pinches one or more items of media therebetween. The support surface 311 has a curved cross-section which cups an incoming item of media that is pinched between the support surface and the plate element. This helps control movement and location of an item of media which helps prevent jamming.

In use, an item of media is located at an input recess 306 by a transport pathway. A leading edge of the item of media is moved into the container region by rotation of the roller 307 and an opposed roller 330. The roller 307 is a driven roller whilst the opposed roller 330 may be a free-wheeling roller or idler or may additionally be a driven roller which is driven in co-operation with the drive applied to the opposed roller 307. The item falls by gravity as well as by virtue of the driving force of the rollers downwards adjacent to the support surface 311. The rollers urge the item downwardly between the pinch point between the support surface and the free end of the support plate. If the item of media is a first item of media in the container region then the item is pinched between an outer surface 311 of the support surface and an inner surface 313 of the plate. If there are one or more preceding items of media already in the container region and thus the incoming item of media is a next item of media, then the incoming item of media is pinched between the support surface and an outer surface (not shown) of an immediately preceding item of media stacked in the container region.

Figure 4:
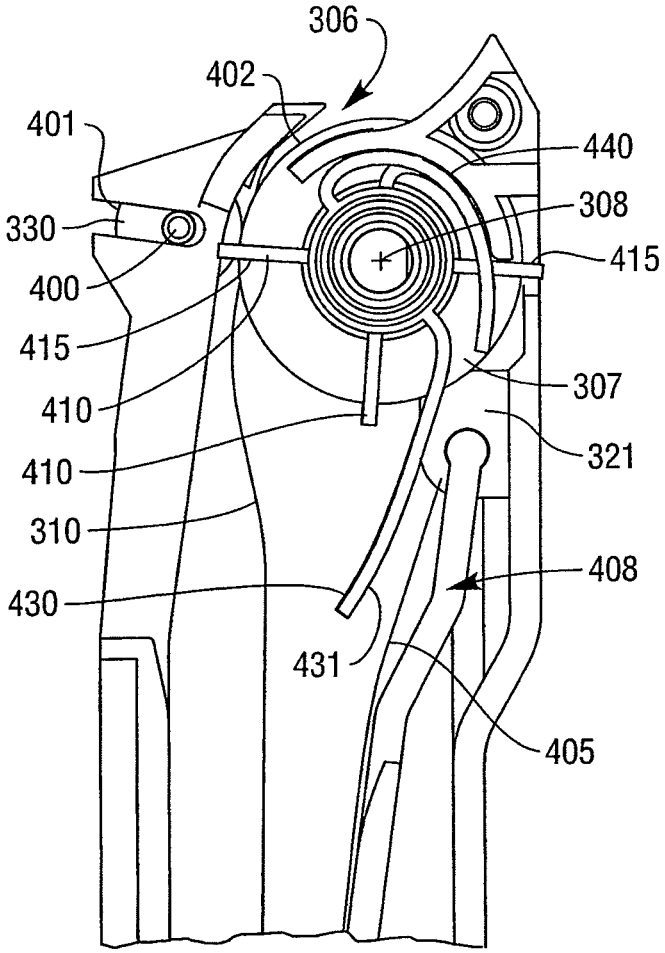
FIG. 4 illustrates parts of the stacking mechanism shown in FIG. 3 in more detail.

FIG. 4 illustrates the rotating rollers and inlet slot 306 in more detail. The free-wheeling or driven roller 330 rotates about a respective axis of rotation 400. An outer surface 401 of this roller is located so as to rotate against a corresponding outer surface 402 of the driven roller 307. As an incoming item of media is presented at the pinch point between the rollers by passing through the slot 306 formed between a side wall and the surface 402 of the roller, the items are located downwardly. FIG. 4 helps illustrate the deposit position of an incoming item of media 310.

Also seen in FIG. 4 is a stacked position for items of media. The one or more items of media 405 shown in the stacked position shows how generally an incoming item of media is located from a deposit position into a stack position in which the item is located against the pinch plate. This occurs by locating the trailing edge of an incoming item of media from a more or less upright position shown at the deposit position into a position where the trailing edge is leant against the dished region 408 of the pinch plate.

The rotating roller 307 includes a number of elements which help duly locate an incoming item of media as well as help maintain already stacked items of media in a stacked location. As seen in FIG. 4, four flexible paddles 410 are carried by the roller 307 and rotate therewith. The roller may be a single substantially cylindrical drum with paddles on one end or both ends thereof, or maybe a slit element with paddles located in the middle and/or at the ends. As the paddles rotate, eventually one of those paddles will engage with a trailing end of the last item of media which has been introduced at a deposit position. A leading surface 415 of the paddle will engage with the trailing edge of the item and begin to move that item edge towards the stacked position.

The roller element also includes two flaps 430 which each include a leading surface 431. The location of the flaps and paddles is pre-selected, along with the number of such flaps and paddles, so that the flaps are urged against any items of media already located and supported by the pinch at the storage location. This effectively locates a trailing edge of the stacked items of media against the dished region 408 of the pinch plate. This thus helps prevent a trailing edge of a pre-stacked item of media which might otherwise be located near to an incoming item of media from colliding with an incoming item of media as it is incoming and is then located into the stacked position. The paddles and flaps rotate simultaneously and are sufficiently flexible to prevent tearing or other damage to the items of media as well as being able to bend as the roller and paddle and flaps rotate against an arcuate surface 440 at the upper end of the vertical storage bin.

Aptly, the flaps are manufactured from a resilient material such as rubber or the like. These tend to impart a vibration force to the items in the stack. The vibration gradually causes the items in the bin to settle downwards with gravity. The most recent item to be located in the stack does not settle downwards because the rubber flaps push it upwards with every rotation. The items in the stack behind this latest item are not impacted by the flaps and will slowly settle downwards because of the vibration. The inlet drive is aptly only operated when items are actually entering the storage bin in order to minimize the settling effect.

In use items of media are thus located one-by-one at a presentation location around a slot 306 which is proximate to a roller 307. Subsequently an incoming item of media is located from that presentation position to a deposit position by rotating at least the driven roller 307. Optionally, the 'idle' roller may be driven and the 'driven' roller idles. The flaps and paddles are driven separately. As an item of media moves to the deposit location, a leading edge of that incoming item of media is pinched by urging a plate against the support surface. An incoming item of media is thus supported in an upright position and in a cupped position. By constantly rotating the roller 307 which thus constantly rotates the flaps and paddles driven by the same shaft as the roller or carried on the roller, the flaps and paddles are repeatedly bent against an arcuate surface 440 which is spaced apart from, but in a juxtaposed relationship with, the roller. The paddles constantly rotate to present one paddle as appropriate at a trailing edge of an incoming item of media and thus begin to locate the item of media from the deposit position to a stack position. Likewise, the position of the flaps is located circumferentially around the roller with respect to the paddles so that in hand with the paddles locating a trailing edge, any trailing edge of any pre-stacked items is kept out of the way by a flap being urged against the pre-stacked item. Aptly, the flaps are longer in length than the paddles.

Certain embodiments of the present invention thus control the tail end of items in a stack to keep them out of the way of incoming items. A pinch (or friction) point past a last drive point prevents a last item in the stack from dropping away from the rollers driving the items. Additionally, a short flap on the drive roller kicks a tail end of the item around and out of the way. A longer flap on the drive roller next to the short flap holds the tail end of an item away from an incoming item. The long flap turns with the drive roller constantly flapping against the tail end of the stacked item and holding it away from a leading edge of a next item coming in. The two types of flap/paddle are attached to the drive roller and run with it continually flapping away keeping the tail end of any item out of the way of incoming items. As an item of media enters the stacking mechanism, it is driven by a drive wheel and opposing pinch roller such as a pinch idler. The lead edge of the item pushes past a lower pinch point. When the tail end of the incoming item comes off the drive, the incoming item is held up by the lower pinch. The incoming item is cupped as it approaches the lower pinch to prevent buckling. The pinch force does not have to hold up an entire stack, only the last item that has previously entered the bin. In this sense, earlier items can begin to slip and fall as urged by gravity towards the bottom floor of the bin. The short flaps then kick the tail end of the item around and onto a stack. The longer flaps keep the tail end of the last item in the stack out of the way of the next incoming item.

Certain embodiments of the present invention provide a combination of pinch point, short and long flaps/paddles and these create a significant improvement relative to prior known systems.

The combination of short and long flexible elements separates the functions of kicking the tail end of an incoming item around and then holding it away from a subsequent incoming item. Buckling of items in a stack is avoided thus achieving higher capacities for storage of items in the same space.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for stacking items of media in a media container region, comprising:

a rotatable roller element arranged to rotate about a longitudinal axis to locate an incoming item of media at a deposit position within a container region;

at least one trailing edge engaging element that engages with a trailing edge region of the incoming item of media and urges the trailing edge region towards a stack position;

at least one preceding item edge engaging element that engages with an edge region of a preceding item of media to urge said edge region of the preceding item of media away from the incoming item of media; and said at least one trailing edge engaging element, comprises a plurality of flexible paddle elements and said at least one preceding item edge engaging element comprises a plurality of flexible flap elements, said plurality of paddle elements and said plurality of flap elements being supported in a circumferentially spaced apart relationship on said roller element and arranged to rotate simultaneously therewith.

2. The apparatus as claimed in claim 1, further comprising:

the flap elements extend further from a common axis of rotation than the paddle elements.

3. The apparatus as claimed in claim 1, further comprising:

the roller element is a driven roller opposed with a respective pinch idler element.

4. The apparatus as claimed in claim 1, further comprising:

a support surface and an opposed pinch plate element, the plate element being resiliently biased against the support surface to provide a pinch point to locate a pinch region of an incoming item of media; wherein the support surface and pinch plate element are located whereby an item of media held at the pinch point has a trailing edge region located for engagement with said at least one trailing edge engaging element.

5. An automated teller machine (ATM) comprising a deposit module comprising the apparatus as claimed in claim 1, wherein each item of media comprises at least one of a currency note and a check.

6. A method of stacking items of media in a media container, comprising the steps of:

rotating a roller element about a longitudinal axis to locate an incoming item of media at a deposit position in a media container region;

urging an edge region of a preceding item of media away from the incoming item of media via at least one preceding item edge engaging element, the at least one preceding item edge engaging element including a plurality of flexible flap elements;

urging a trailing edge of the incoming item of media towards a stack position via at least one trailing edge engagement element, the at least one trailing edge engagement element including a plurality of flexible paddle elements; and as the roller element rotates, simultaneously rotating the plurality of flexible paddle members and the flexible flap elements arranged in a circumferentially spaced apart relationship on the roller element, rotation of a one of said flexible flap elements, urging said edge region and rotation of a one of said flexible paddle elements, urging said trailing edge.

7. The method as claimed in claim 6, further comprising the steps of:

locating items of media one-by-one at a presentation location proximate to said roller element; and subsequently locating each item from said presentation location to said deposit position by rotating the roller element.

8. The method as claimed in claim 6, further comprising the steps of:

pinching an incoming item of media located at the deposit position by urging a plate element against a support surface, a pinch region of the incoming item of media at the deposit position being located between the plate element and the support surface.

9. The method as claimed in claim 6, further comprising the steps of:

constantly rotating said roller element thereby constantly rotating said plurality of flap elements and said plurality of paddle elements; and as the roller element rotates, repeatedly bending each flap-element and paddle element against an arcuate support surface located in a spaced apart juxtaposed relationship with said roller element.

10. The method according to claim 6, wherein the method is performed by a computer having a memory executing one or more programs of instructions which are tangibly embodied in a program storage medium readable by the computer.

11. Apparatus for stacking items of media in a media container region, comprising:

a rotatable roller element arranged to rotate about a longitudinal axis to locate an incoming item of media at a deposit position within a container region;

at least one trailing edge engaging element that engages with a trailing edge region of the incoming item of media and urges the trailing edge region towards a stack position;

at least one preceding item edge engaging element that engages with an edge region of a preceding item of media to urge said an edge region away from the incoming item of media;

a support surface and an opposed pinch plate element, the plate element being resiliently biased against the support surface to provide a pinch point to locate a pinch region of an incoming item of media;

wherein the support surface and pinch plate element are located whereby an item of media held at the pinch point has a trailing edge region located for engagement with said at least one trailing edge engaging element; and the support surface has a curved cross-section to cup an incoming item of media as it is pinched between the support surface and the plate element.

12. The apparatus as claimed in claim 11, further comprising:

said at least one trailing edge engaging element, comprises a plurality of flexible paddle elements and said at least one preceding item edge engaging element comprises a plurality of flexible flap elements, said plurality of paddle elements and said plurality of flap elements being supported in a circumferentially spaced apart relationship on said roller element and arranged to rotate simultaneously therewith.

13. The apparatus as claimed in claim 12, further comprising:

the flap elements extend further from a common axis of rotation than the paddle elements.

14. The apparatus as claimed in claim 11, further comprising:

the roller element is a driven roller opposed with a respective pinch idler element.

15. An automated teller machine (ATM) comprising a deposit module comprising the apparatus as claimed in claim 11, wherein each item of media comprises at least one of a currency note and a check.

16. Apparatus for stacking items of media in a media container region, comprising:

a rotatable roller element arranged to rotate about a longitudinal axis to locate an incoming item of media at a deposit position within a container region;

at least one trailing edge engaging element that engages with a trailing edge region of the incoming item of media and urges the trailing edge region towards a stack position;

at least one preceding item edge engaging element that engages with an edge region of a preceding item of media to urge said an edge region away from the incoming item of media;

a support surface and an opposed pinch plate element, the plate element being resiliently biased against the support surface to provide a pinch point to locate a pinch region of an incoming item of media;

wherein the support surface and pinch plate element are located whereby an item of media held at the pinch point has a trailing edge region located for engagement with said trailing edge engaging element; and the pinch plate element is a substantially planar plate member having a dished region at a first end region thereof where the plate element is pivotably mounted and a further end region comprising a free end biased against the support surface.

17. The apparatus as claimed in claim 16, further comprising:

said at least one trailing edge engaging element, comprises a plurality of flexible paddle elements and said at least one preceding item edge engaging element comprises a plurality of flexible flap elements, said plurality of paddle elements and said plurality of flap elements being supported in a circumferentially spaced apart relationship on said roller element and arranged to rotate simultaneously therewith.

18. The apparatus as claimed in claim 17, further comprising:

the flap elements extend further from a common axis of rotation than the paddle elements.

19. The apparatus as claimed in claim 16, further comprising:

the roller element is a driven roller opposed with a respective pinch idler element.

20. An automated teller machine (ATM) comprising a deposit module comprising the apparatus as claimed in claim 16, wherein each item of media comprises at least one of a currency note and a check.

21. A method of stacking items of media in a media container, comprising the steps of:

rotating a roller element about a longitudinal axis to locate an incoming item of media at a deposit position in a media container region;

urging an edge region of a preceding item of media away from the incoming item of media via at least one preceding item edge engaging element;

urging a trailing edge of the incoming item of media towards a stack position via at least one trailing edge engagement element;

pinching an incoming item of media located at the deposit position by urging a plate element against a support surface, a pinch region of the incoming item of media at the deposit position being located between the plate element and the support surface; and supporting the item of media in a cupped upright position by pinching the item of media.

22. The method as claimed in claim 21, further comprising the steps of:

as the roller element rotates, simultaneously rotating a plurality of flexible paddle members and flexible flap elements arranged in a circumferentially spaced apart relationship on the roller element, rotation of a one of said flexible flap elements, urging said an edge region and rotation of a one of said flexible paddle elements, urging said a trailing edge.

23. The method according to claim 21, wherein the method is performed by a computer having a memory executing one or more programs of instructions which are tangibly embodied in a program storage medium readable by the computer.

24. The method as claimed in claim 21, further comprising the steps of:

locating items of media one-by-one at a presentation location proximate to said roller element; and subsequently locating each item from said presentation location to said deposit position by rotating the roller element.

25. The method as claimed in claim 21, further comprising the steps of:

pinching an incoming item of media located at the deposit position by urging a plate element against a support surface, a pinch region of the incoming item of media at the deposit position being located between the plate element and the support surface.

26. The method as claimed in claim 22, further comprising the steps of:

constantly rotating said roller element thereby constantly rotating said plurality of flap elements and said plurality of paddle elements; and as the roller element rotates, repeatedly bending each flap element and paddle element against an arcuate support surface located in a spaced apart juxtaposed relationship with said roller element.

* * * * *